US009901972B2

(12) United States Patent
Rayburn

(10) Patent No.: US 9,901,972 B2
(45) Date of Patent: Feb. 27, 2018

(54) END CLOSURE WITH LARGE OPENING RING PULL TAB

(71) Applicant: Ball Corporation, Broomfield, CO (US)

(72) Inventor: Robert M. Rayburn, Broomfield, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 14/641,035

(22) Filed: Mar. 6, 2015

(65) Prior Publication Data

US 2015/0251803 A1 Sep. 10, 2015

Related U.S. Application Data

(60) Provisional application No. 61/949,404, filed on Mar. 7, 2014.

(51) Int. Cl.

| | |
|---|---|
| ***B65D 17/34*** | (2006.01) |
| ***B21D 51/38*** | (2006.01) |
| ***B65D 17/00*** | (2006.01) |
| ***B21D 51/44*** | (2006.01) |

(52) U.S. Cl.

CPC ..... *B21D 51/383* (2013.01); *B21D 51/443* (2013.01); *B65D 17/165* (2013.01); *B65D 2101/00* (2013.01)

(58) Field of Classification Search

CPC ..... B65D 17/165; B65D 2517/0013; B65D 2517/0014

See application file for complete search history.

(56) References Cited

U.S. PATENT DOCUMENTS

| | | | |
|---|---|---|---|
| 2,317,420 | A | 4/1943 | Taylor |
| 3,159,304 | A | 12/1964 | Kolde et al. |
| 3,334,775 | A | 8/1967 | Klein et al. |
| 3,362,569 | A | 1/1968 | Geiger |
| 3,401,819 | A | 9/1968 | Salamone |
| 3,441,168 | A | 4/1969 | Luviano |
| 3,463,347 | A | 8/1969 | Kerr |

(Continued)

FOREIGN PATENT DOCUMENTS

| | | |
|---|---|---|
| AU | 2005202056 | 12/2005 |
| CA | 2662199 | 3/2008 |

(Continued)

OTHER PUBLICATIONS

International Search Report and Written Opinion for International (PCT) Patent Application No. PCT/US15/19265, dated Jun. 10, 2015 9 pages.

(Continued)

*Primary Examiner* — Shawn M Braden

(74) *Attorney, Agent, or Firm* — Sheridan Ross P.C.

(57) ABSTRACT

An end closure for food and beverage containers is provided. The end closure comprises a central panel with a large opening defined by a score line. The end closure further comprises a ring pull tab operably interconnected to the central panel proximate to a peripheral edge of the central panel. Prior to opening the end closure, a tail end of the ring pull tab is positioned over the tear panel. In some embodiments, the tear panel may completely detach from the end closure upon opening.

20 Claims, 5 Drawing Sheets

(56) References Cited

U.S. PATENT DOCUMENTS 3,643,832 A 2/1972 Khoury
3,667,643 A 6/1972 Patel
3,672,535 A 6/1972 McGuire
3,726,432 A 4/1973 Gentile
3,762,598 A * 10/1973 Gayner ..... B21D 51/383 156/257
3,807,597 A 4/1974 Wells et al.
3,836,038 A 9/1974 Cudzik
3,838,788 A 10/1974 Stargell
3,853,242 A 12/1974 Zundel
3,877,604 A 4/1975 Brown
3,949,692 A 4/1976 DeLine et al.
3,951,331 A 4/1976 Smith et al.
RE28,910 E 7/1976 Dalli et al.
3,967,752 A 7/1976 Cudzik
3,977,561 A 8/1976 Strobe et al.
4,015,744 A 4/1977 Brown
4,024,981 A 5/1977 Brown
4,030,631 A 6/1977 Brown
4,047,634 A 9/1977 McGeehin et al.
4,061,243 A 12/1977 Khoury
4,062,471 A 12/1977 Perry
4,073,399 A 2/1978 Lewis
4,084,721 A 4/1978 Perry
4,111,325 A 9/1978 Bellamy et al.
4,125,203 A 11/1978 Sovari et al.
4,148,410 A 4/1979 Brown
4,150,765 A 4/1979 Mazurek
4,171,062 A 10/1979 Allen et al.
4,181,232 A 1/1980 Bellamy et al.
4,184,607 A 1/1980 Potts
4,197,956 A 4/1980 Murayama
4,210,257 A 7/1980 Radtke
4,211,335 A 7/1980 Langseder
4,219,127 A 8/1980 Bielicki
D257,228 S 10/1980 Saunders
4,241,841 A 12/1980 Boller
4,266,688 A 5/1981 Reid
4,276,993 A 7/1981 Hasegawa
4,286,728 A 9/1981 Fraze et al.
4,320,850 A 3/1982 Drolen, Jr.
4,337,870 A 7/1982 Keeler
4,345,696 A 8/1982 Guimarin
4,361,251 A 11/1982 Langseder et al.
4,363,419 A 12/1982 Walz, Sr.
4,367,996 A 1/1983 Saunders
4,372,462 A 2/1983 Dassler
4,433,793 A 2/1984 Ingemann
4,434,904 A 3/1984 D'Amico et al.
4,465,204 A 8/1984 Kaminski et al.
4,489,864 A 12/1984 Davis
4,503,989 A * 3/1985 Brown ..... B65D 17/165 220/269
4,513,875 A 4/1985 Kuehn
D279,265 S 6/1985 Turner et al.
4,527,700 A 7/1985 Jupin et al.
4,527,701 A 7/1985 Schaubeck
4,541,541 A 9/1985 Hickman et al.
4,567,995 A 2/1986 Kreiseder et al.
4,598,837 A 7/1986 Kreiseder et al.
D285,661 S 9/1986 Brownhill
4,611,725 A 9/1986 Kacalieff
4,660,735 A 4/1987 Peschardt et al.
4,673,099 A 6/1987 Wells
4,674,649 A 6/1987 Pavely
4,681,238 A 7/1987 Sanchez
4,696,410 A 9/1987 Kreiseder
4,709,830 A 12/1987 Kreiseder
4,717,039 A 1/1988 Ayyoubi
4,733,793 A 3/1988 Moen
4,747,511 A 5/1988 Dutt et al.
4,768,667 A 9/1988 Magnusson
4,787,530 A 11/1988 Edwards
4,792,054 A 12/1988 Weidman
4,815,626 A * 3/1989 Yamanashi ..... B65D 17/165 220/273
D300,608 S 4/1989 Taylor et al.
4,846,374 A 7/1989 Gabrys
D304,302 S 10/1989 Dalli et al.
4,887,732 A 12/1989 Matsubayashi et al.
4,893,725 A 1/1990 Ball et al.
4,901,435 A 2/1990 Tahara
4,901,880 A 2/1990 Tatham et al.
4,913,304 A 4/1990 Corey
4,930,658 A 6/1990 McEldowney
4,934,554 A 6/1990 Edwards
4,994,009 A 2/1991 McEldowney
D315,507 S 3/1991 Ochs
5,007,231 A 4/1991 Ingemann
5,007,554 A 4/1991 Hannon et al.
5,011,037 A 4/1991 Moen et al.
5,027,968 A 7/1991 Timson
5,059,360 A 10/1991 Sato
5,064,087 A 11/1991 Koch
5,090,581 A 2/1992 Rose et al.
5,103,973 A 4/1992 Sato
5,129,530 A 7/1992 Fuchs
5,129,541 A 7/1992 Voigt et al.
5,129,773 A 7/1992 Shock
5,161,713 A 11/1992 English
5,167,338 A 12/1992 Kick
5,193,704 A 3/1993 Kick
5,199,591 A 4/1993 Thibeault et al.
5,205,430 A 4/1993 Valyi
D337,521 S 7/1993 McNulty
5,261,548 A 11/1993 Barker et al.
5,269,432 A 12/1993 Beckertgis
5,307,947 A 5/1994 Moen et al.
5,328,313 A 7/1994 Saunders
D352,898 S 11/1994 Vacher
5,375,729 A 12/1994 Schubert
5,383,582 A 1/1995 Baxter et al.
5,402,921 A 4/1995 Forsyth et al.
5,405,039 A 4/1995 Komura
5,421,472 A 6/1995 Beckertgis
D364,807 S 12/1995 Taylor
D365,274 S 12/1995 Cook
D365,988 S 1/1996 Clarke, III
D366,832 S 2/1996 Lo
5,494,184 A 2/1996 Noguchi et al.
5,505,326 A 4/1996 Junko
D371,073 S 6/1996 Taylor
5,522,521 A 6/1996 Nagashio
5,555,992 A 9/1996 Sedgeley
5,562,226 A 10/1996 Valyi et al.
5,566,850 A 10/1996 Forsyth et al.
5,660,290 A 8/1997 Hayes
5,692,633 A 12/1997 Gordon
5,711,447 A 1/1998 Plester
5,711,448 A 1/1998 Clarke, III
5,738,236 A 4/1998 Brun
5,758,793 A 6/1998 Forsyth et al.
5,762,230 A 6/1998 Policappelli
5,829,623 A 11/1998 Otsuka et al.
5,850,951 A 12/1998 Hayes
D406,236 S 3/1999 Brifcani et al.
5,934,498 A 8/1999 Jordan
5,947,315 A 9/1999 Valyi et al.
5,947,318 A 9/1999 Palm
6,024,239 A 2/2000 Turner et al.
6,050,440 A 4/2000 McEldowney
6,059,137 A 5/2000 Westwood et al.
6,158,608 A 12/2000 Schlattl
6,164,480 A 12/2000 Heinicke et al.
6,206,222 B1 3/2001 Cudzik
6,206,227 B1 3/2001 Ferri
6,216,904 B1 4/2001 Cagan
6,260,728 B1 7/2001 Turner et al.
6,405,889 B1 6/2002 Neiner
6,431,384 B1 8/2002 Dubach
6,450,358 B1 9/2002 Berro
6,626,314 B1 9/2003 McHenry et al.
6,739,471 B2 5/2004 Goetz et al.

(56) References Cited

U.S. PATENT DOCUMENTS

| | | | | |
|---|---|---|---|---|
| 6,755,315 | B1 | 6/2004 | Mueller | |
| 6,763,963 | B1 | 7/2004 | Martin | |
| 6,772,901 | B2 | 8/2004 | Witt | |
| 6,793,087 | B2 | 9/2004 | Dyren | |
| 6,817,819 | B2 | 11/2004 | Olson et al. | |
| 6,851,568 | B2 | 2/2005 | Herrmann | |
| 6,851,576 | B2 | 2/2005 | Dubach | |
| 6,883,689 | B2 | 4/2005 | Odet | |
| 6,889,862 | B2 | 5/2005 | Vaughan | |
| 6,910,598 | B2 | 6/2005 | Gotz et al. | |
| 7,152,766 | B1 | 12/2006 | Walsh et al. | |
| 7,178,683 | B2 | 2/2007 | Birkmayer et al. | |
| 7,198,168 | B2 | 4/2007 | Mizuma | |
| 7,198,170 | B2 | 4/2007 | Herr | |
| 7,237,698 | B2 | 7/2007 | Jackman | |
| D576,878 | S | 9/2008 | Brashear | |
| D582,275 | S | 12/2008 | Reed et al. | |
| 7,513,381 | B2 | 4/2009 | Heng et al. | |
| 7,549,547 | B2 | 6/2009 | Herr et al. | |
| 7,591,392 | B2 * | 9/2009 | Watson | B65D 17/08 220/619 |
| D606,864 | S | 12/2009 | Robinson | |
| 7,823,740 | B2 | 11/2010 | Perra | |
| D632,958 | S | 2/2011 | Fuchs | |
| D636,265 | S | 4/2011 | Gartner | |
| 7,950,542 | B2 | 5/2011 | Steadman | |
| 8,157,119 | B2 | 4/2012 | Watson et al. | |
| 8,720,717 | B2 | 5/2014 | Kaanta et al. | |
| 9,592,569 | B2 | 3/2017 | Reed et al. | |
| 9,616,483 | B2 | 4/2017 | Stammen | |
| 9,714,114 | B2 | 7/2017 | Kittler et al. | |
| 2001/0022304 | A1 | 9/2001 | Roche | |
| 2003/0010781 | A1 | 1/2003 | Odet | |
| 2003/0213803 | A1 | 11/2003 | Chasteen | |
| 2004/0188440 | A1 | 9/2004 | Schlattl et al. | |
| 2006/0151421 | A1 | 7/2006 | Rho | |
| 2007/0017891 | A1 | 1/2007 | Herr et al. | |
| 2007/0095835 | A1 | 5/2007 | Lohrman et al. | |
| 2007/0164026 | A1 | 7/2007 | Morrissey et al. | |
| 2008/0156802 | A1 | 7/2008 | Yauk et al. | |
| 2008/0237178 | A1 | 10/2008 | Laburu | |
| 2008/0302752 | A1 | 12/2008 | Farrar et al. | |
| 2010/0059516 | A1 | 3/2010 | Parker et al. | |
| 2010/0258563 | A1 | 10/2010 | Parrinello et al. | |
| 2011/0056945 | A1 | 3/2011 | Ramsey et al. | |
| 2017/0113835 | A1 | 4/2017 | Mitchell et al. | |
| 2017/0173657 | A1 | 6/2017 | Stammen | |

FOREIGN PATENT DOCUMENTS

| | | |
|---|---|---|
| CA | 148866 | 9/2013 |
| CN | 302041222 | 8/2012 |
| CN | 103029888 | 4/2013 |
| CN | 302412019 | 4/2013 |
| CN | 302413392 | 4/2013 |
| CN | 203158379 | 8/2013 |
| CN | 103287663 | 9/2013 |
| CN | 302605385 | 10/2013 |
| CN | 203638300 | 6/2014 |
| EP | 0040277 | 4/1984 |
| EP | 0340835 | 11/1989 |
| EP | 0432659 | 6/1991 |
| EP | 1577222 | 9/2005 |
| EP | 2253552 | 11/2010 |
| EP | 2429736 | 5/2017 |
| EP | 2800705 | 9/2017 |
| GB | 1200565 | 7/1970 |
| JP | 2000-159929 | 6/2000 |
| JP | 2002-145263 | 5/2002 |
| WO | WO 2007/054568 | 5/2007 |
| WO | WO 2011/026900 | 3/2011 |
| WO | WO 2011/053776 | 5/2011 |
| WO | WO 2011/156140 | 12/2011 |
| WO | WO 2013/182354 | 12/2013 |
| WO | WO 2015/070051 | 5/2015 |
| WO | WO 2017/097903 | 6/2017 |

OTHER PUBLICATIONS

International Preliminary Report on Patentability for International (PCT) Patent Application No. PCT/US2015/019265, dated Sep. 22, 2016, 8 pages.

Official Action with English Translation for China Patent Application No. 201580017661.8, dated Sep. 25, 2017, 23 pages.

* cited by examiner

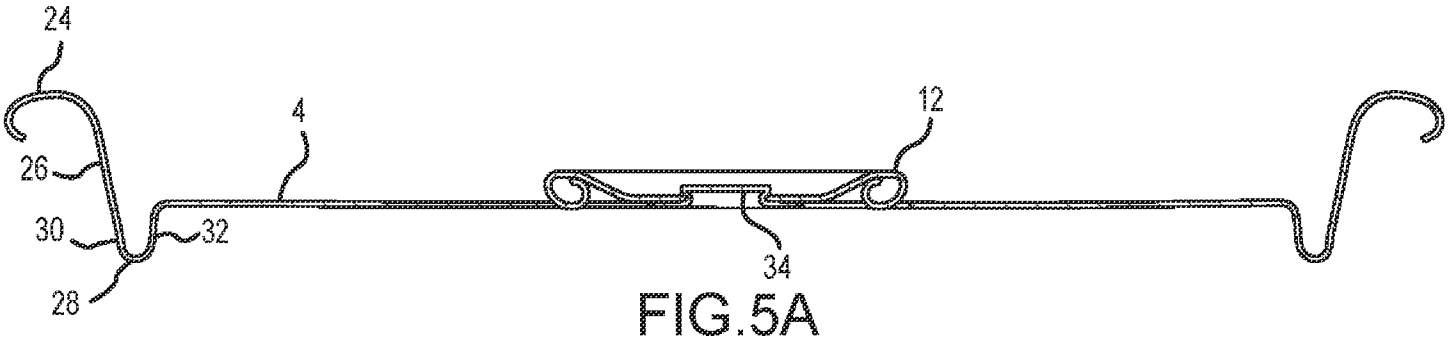
FIG.5A
PRIOR ART
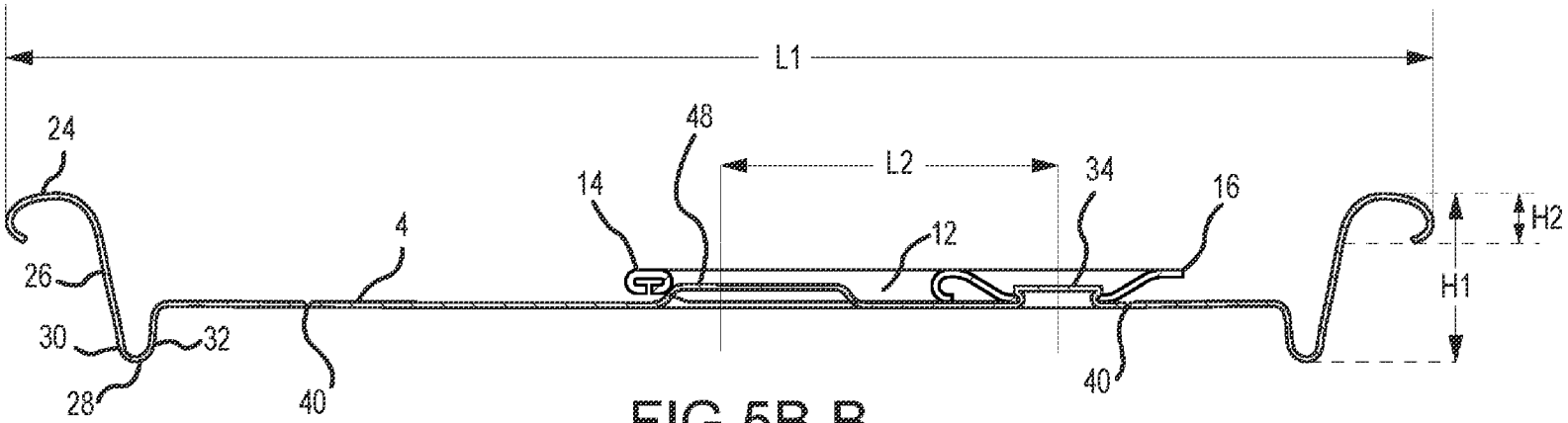
FIG.5B-B

END CLOSURE WITH LARGE OPENING RING PULL TAB

CROSS-REFERENCE TO RELATED APPLICATION

This application claims priority to U.S. Provisional Patent Application Ser. No. 61/949,404, filed Mar. 7, 2014, the entire disclosure of which is incorporated by reference herein.

FIELD OF THE INVENTION

Embodiments of the present invention generally relate to containers and container end closures, and more specifically to metallic beverage container end closures with large openings and pull tabs.

BACKGROUND OF THE INVENTION

Containers, and more specifically metallic beverage containers, generally contain a neck on an upper portion that is adapted for interconnection to a metallic end closure. The container end closure is formed from a flat sheet of metallic material and generally includes a pull tab, ring pull, or other form of opening device. Beverage containers commonly store carbonated beverages, thus, both the container body and the container end closure are required to withhold internal pressures up to 90 psi while under varying temperatures without catastrophic failure or permanent deformation. Further, the container end closure must be manufactured, stacked, shipped, and sent to a filler prior to being seamed onto a container body filled with a carbonated beverage. Thus, the container and end closure must be designed to resist deformation and failure while utilizing thin metallic materials and allowing compact stacking during shipping and manufacturing.

Food and beverage containers with pull tabs, stay on tabs ("SOTs"), ring pulls, and pull aperture openings are generally known. Ring pulls (also called pull rings), ring pull tabs, and pull tabs are generally secured to the end closure by a rivet located in the center of the central panel, which limits the size of the opening because the opening can only extend from the periphery of the central panel to the rivet at the center of the panel. Additionally, the initial opening point is generally adjacent to the rivet, which is traditionally located in the center of the end closure. SOTs are generally secured to the central panel and rotated by a user to push the nose of the SOT on the tear panel, which is fractured from the end closure along a score line. The ring pull is secured to the end closure within the tear panel, which is defined by a score line, such that when the user pulls the ring pull tab, the score line fractures and the tear panel with the pull ring tab is torn completely off and discarded.

Known end closures with center-located rivet ring pulls have reached the limit of opening size. Thus, the opening in the end closure cannot be increased beyond current designs if the ring pull rivet is located in the center of the end closure.

Additionally, end closures may buckle when under varying temperatures and internal pressure. If an end closure buckles near the score line and opening, then the score line may crack and release the contents of the container. This is called "peak and leak." To prevent buckling and peak and leak, end closures may be made of thicker metal. However, this approach increases production cost and the amount of force needed to fracture the score line.

An important feature of end closures is their ability to resist abuse during transport and stacking. A particular problem in this regard is the possibility that when a filled container is stacked on top of another filled container, e.g., during transport, the base of the upper container pushes down on the tab of the lower container. This can cause the score formed around the tear panel of the lower container to fracture. A known solution to this problem is to form a pair of downwardly projecting points or nibs on either side of the tab that project downward slightly further than the point of the tab nose. These additional points typically contact the surface of the end closure in the unopened configuration and, in the event of an impact on the container (e.g., due to stacking), prevent the nose from coming into contact with the end closure. When the lift ring or tail of the tab is raised to open the end closure, however, the tab pivots about these points allowing the nose to impact the end closure and fracture the score. It is possible to achieve a similar effect by providing a pair of raised dimples on the end closure, under and in contact with the tab. However, in designs that provide a circumferential bead extending behind the nose of the tab, the bead will tend to interfere with the raised dimples.

Accordingly, there exists a significant need for a container end closure with a ring pull tab that has an increased opening size, allows for faster pouring, increases access to the scent of the container's contents, enhances the content's flavor, and resists abuse during transport and stacking.

Due to the numerous limitations associated with the prior art described above, the following disclosure describes an improved container end closure that is adapted for interconnection to a container body and that employs a large opening for faster pouring. This novel design provides buckle resistance, prevents inadvertent opening, and significantly improves the end closure's pour rate.

SUMMARY OF THE INVENTION

These and other needs are addressed by the various embodiments and configurations of the present invention. This invention relates to a novel system, device, and methods for providing a food and beverage container end closure with a large opening and faster pour rate than existing designs.

Features of the present invention may be employed in a wide range of food and beverage containers, including pressurized beverage containers with ring pull tabs secured by a rivet, pressurized beverage containers with stay on tabs ("SOTs") secured by a rivet, food containers with tear away lids, and full-panel easy-open ends with tabs, to name a few. Although the invention generally relates to metallic end closures and containers, the invention and features described herein could easily be implemented on plastic containers and end closures.

Thus, it is one aspect of various embodiments of the present invention to provide a metallic end closure for a container with a larger opening, faster pouring features, and improved access to the scent of the container's contents. Specifically, the container may hold beer, carbonated beverages, other liquids, food, pasteurized products, vacuum-packed products, nutraceuticals, or infant formula.

One aspect of embodiments of the present invention is to provide an end closure that has satisfactory pressure performance and satisfactory opening performance, whilst still being able to accommodate abuse resistance features.

Another aspect of the embodiment is to provide an end closure with a rigid panel and a ring pull tab interconnected to the tear panel that requires less force to open. Thus, the force required for a user to fracture the score and open the pour opening is reduced.

It is thus one aspect of embodiments of the present invention to provide an end closure with a ring pull or pull tab secured by a rivet offset from the center of the end closure. One advantage of some embodiments is that the opening size is increased, which increases the pour rate and improves the smoothness of the pour. Additionally, the larger opening allows more of the product's scent to reach the user's nose, which enhances the flavor of the product. Note that the terms "ring pull tab," "pull tab," and "tab" may be used interchangeably herein.

Another aspect of embodiments of the present invention is a method for manufacturing an end closure with an increased opening size. More specifically, a method for forming a beverage can end closure is provided, wherein the container end closure is provided with a ring pull tab or pull tab that is secured to the end closure by an offset rivet. In some embodiments, the end closure may also have beads and/or abuse resistance features.

One aspect of embodiments of the present invention is to provide a container end closure that is manufactured with conventional manufacturing equipment. It is a further aspect of embodiments of the present invention to provide an end closure that fits standard sizes of food and beverage containers.

In various embodiments, an end closure is provided with a ring pull, wherein the pull tab is riveted to the end closure central panel at a location offset from the tear panel. By offsetting the point at which the tab is riveted to the end closure, the size of the tear panel can extend beyond the center of the panel, thus allowing the tear panel to be significantly larger. Furthermore, by offsetting the rivet location, the initial opening point of the tear panel may be extended farther away from the final opening point of the tear panel, which increases the opening area.

In one embodiment, an end closure is provided with a SOT, wherein the tab is riveted to the end closure at a location offset from the center of the panel. By offsetting the point at which the tab is riveted to the end closure, the size of the tear panel can extend beyond the center of the panel, thus allowing the tear panel to be significantly larger. For example, the opening area can be between 40% and 50% of the area of the central panel.

In some embodiments of the end closure with an offset rivet, the tab is oriented in the opposite direction as traditional tabs. Thus, the tail end (or pull ring) of the tab will be positioned on the same side of the rivet as the tear panel and opening. This is because if the tab is offset from the center of the end closure and is riveted in the traditional configuration (i.e., the pull end is located on the opposite side of the rivet from the tear panel), then the tab would extend beyond the periphery of the central panel. In some embodiments, the tab may be oriented in the traditional configuration and would also be smaller in size than traditional pull rings and tabs. However, smaller pull rings and tabs may be more difficult to use and users may find it more difficult to open the container. Thus, other embodiments use a standard-sized tab and orient the tail end of the tab over the tear panel.

In one embodiment, one or more beads are formed in the central panel and adjacent to the score to provide rigidity to the central panel and to allow the tear panel to be removed after the score is propagated by utilizing the pull ring. The beads may be called "beads," "stiffening beads," "strengthening beads," "linear beads," and/or "tab beads" herein. The one or more beads can be raised or lowered with respect to a substantially horizontal plane of the panel. Additionally, strengthening beads make the panel rigid and reduce the force needed to open the opening.

In one embodiment with an offset rivet and a ring pull tab positioned above the tear panel, a user may open the container by pulling the ring upwardly and away from the user until the tab is in a vertical position. Then the user will pull the ring back toward the user to completely detach the tab and tear panel from the end closure.

In some embodiments, to open the container the user pulls the tab upwardly, which fractures the score. The score may be fractured at the 12 o'clock position in one embodiment. The user then pulls the tab outwardly and away from the end closure to completely detach the score panel from the end closure, similar to the opening procedure of a full panel food end closure.

In one embodiment having an offset rivet and a SOT with the tail end positioned above the tear panel, the hinge on the tear panel may be positioned at the bottom (6 o'clock position) of the opening. Thus, a user may open the container by pulling the tab upwardly and away from the user until the tab is in a vertical position, then pull the tab back toward the user and push the tab and tear panel into the container, bending the tear panel at the hinge.

In another embodiment, the user opens the end closure by raising the tail of the tab such that the nose of the tab is pressed against the upper surface of the end closure, which causes the score to fracture initially at a point. In one embodiment, the score line extends to the point at which the nose presses against the end closure and the initial fracture point will be directly under the nose (i.e., at the point at which the nose presses against the end closure). In other embodiments, the score line may not extend much past the rivet. In this embodiment, the score will fracture initially at a point closest to the point at which the nose presses against the end closure. In yet another embodiment, the score line may extend some distance beyond the point at which the nose presses against the end closure and the score will fracture initially at a point closest to the point at which the nose presses against the end closure. In these embodiments, the fracture will propagate along the score line to a second point and a third point, which may be equidistance from the initial fracture point and which may vary in location from embodiment to embodiment. To finish opening the end closure, the user must then pull the tab in a direction away from the initial fracture point and toward the opposite side of the end closure in order to completely fracture the score line.

In one embodiment of the present invention, the end closure comprises a central panel surrounded by a circumferential score and an outer seaming panel. The closure further comprises a tab fixed to the central panel or the tear panel by a rivet formed in the central panel such that lifting of a radially inner region of the tab forces a nose portion of the tab into contact with a region of the central panel adjacent to a radially inner edge of the circumferential score, thereby causing the score to fracture. In an alternate or additional embodiment, the tear panel further includes a bead. The tear panel bead may be shorter than the strengthening beads and/or positioned between the rivet and the center point of the central panel.

In one embodiment, a container end closure adapted for interconnection to a container body is provided. The end closure comprises a tab secured to the end closure by a rivet offset from the center of the end closure. The rivet may be produced using a known "bubble reform" process which generates a circular "witness" mark around the rivet. This process hardens the metal in the area of the rivet including the witness. In some embodiments, the rivet is made of the central panel material.

In one embodiment, a metallic end closure for a beverage container with improved pouring features is provided. The metallic end closure comprises: a peripheral curl which is adapted for interconnection to a neck of a beverage container; a chuck wall extending downwardly from the peripheral curl; a countersink interconnected to a lower end of the chuck wall; an inner panel wall extending upwardly from an interior portion of the countersink; a central panel interconnected to an upper portion of the inner panel wall, the central panel having a center point; a ring pull tab having a nose end and a tail end; and a score line in the central panel which defines a tear panel, wherein the tail end of the ring pull tab is positioned above the tear panel, and wherein the ring pull tab is operably interconnected to the tear panel at an interconnection point located a forward distance from the center point of the central panel. In a further embodiment, the tear panel may be completely detachable from the central panel. In one embodiment, the metallic end closure further comprises a first bead positioned proximate to one side of the score line and a second bead positioned proximate to an opposite side of the score line. In another embodiment, the tear panel of the metallic end closure defines a pour opening of at least about 1.05 square inches and/or the pour opening comprises at least about 41.6% of a total surface area of the central panel. In another embodiment, the pour opening comprises at least about 43.3% of a total surface area of the central panel. In one embodiment, the tear panel comprises a rounded, triangular shape and the tab interconnection point may be positioned proximate to an upper portion of the rounded, triangular-shaped tear panel.

In one embodiment, a metallic end closure for a beverage container with improved pouring features is provided. The metallic end closure comprises: a peripheral curl which is adapted for interconnection to a neck of a beverage container; a chuck wall extending downwardly from said peripheral curl; a countersink interconnected to a lower end of said chuck wall; an inner panel wall extending upwardly from an interior portion of said countersink; a central panel having a perimeter and a center point which is located at an intersection of a vertical axis and a horizontal axis, wherein said perimeter of said central panel is interconnected to an upper portion of said inner panel wall; a score line in said central panel which defines a tear panel, wherein said score line has a first substantially linear portion on a first side of said vertical axis and a second substantially linear portion on a second side of said vertical axis; and a ring pull tab having a nose end and a tail end, wherein said ring pull tab is operably interconnected to said tear panel at an interconnection point positioned on said vertical axis between said center point and said perimeter of said central panel, and wherein said tail end of said ring pull tab is positioned above said tear panel.

In additional embodiments, the tear panel is completely detachable from said central panel. The metallic end closure can further comprise a first bead positioned proximate to said first substantially linear portion of said score line, said first bead including a substantially linear portion which is aligned substantially parallel to said first substantially linear portion of said score line. In one embodiment, the metallic end closure further comprises a second bead positioned proximate to said second substantially linear portion of said score line, said second bead including a substantially linear portion which is aligned substantially parallel to said second substantially linear portion of said score line, and wherein said central panel has increased rigidity. Additionally, the first bead has a length which is longer than a width of said first bead, and wherein said first bead is raised above a substantially horizontal surface of said central panel a height of between about 0.025 inches and 0.035 inches. In some embodiments, the tear panel defines a pour opening of at least about 1.05 square inches. In one embodiment, the tear panel defines a pour opening which comprises at least about 43.3% of a total surface area of the central panel. In various embodiments, the tear panel comprises a rounded, triangular shape. Further, the tab interconnection point is positioned proximate to an upper portion of said rounded, triangular-shaped tear panel, and wherein a lower portion of said rounded, triangular-shaped tear panel comprises a radius of curvature that is substantially the same as a radius of curvature of said perimeter of said central panel.

In one embodiment, a metallic end closure with an enlarged detachable tear panel is provided. The metallic end closure comprises: a peripheral curl which is adapted for interconnection to a neck of a beverage container; a chuck wall extending downwardly from said peripheral curl; a central panel having a perimeter and a center point which is located at an intersection of a vertical axis and a horizontal axis, wherein said perimeter of said central panel is interconnected to said chuck wall; a score line in said central panel which defines the enlarged detachable tear panel, said score line having a first linear leg interconnected by a first radius of curvature to a second linear leg which is interconnected to a third leg by a second radius of curvature, said third leg is interconnected to said first linear leg by a third radius of curvature which is substantially the same as the second radius of curvature; a ring pull tab having a nose end and a tail end, wherein said ring pull tab is operably interconnected to said tear panel at an interconnection point positioned on said vertical axis between said center point and said perimeter of said central panel; a first bead positioned proximate to a first portion of said score line, wherein said first bead is substantially parallel to said first portion of said score line; and a second bead positioned proximate to a second portion of said score line, wherein said second bead is substantially parallel to said second portion of said score line.

In some embodiments, the tail end of said ring pull tab is positioned above said tear panel. In additional embodiments, the metallic end closure further comprises a third bead positioned on said vertical axis between said interconnection point and said center point of said central panel. In various embodiments, the first bead has a length and a width, wherein said length of said first bead is longer than said width of said first bead, wherein said length of said first bead is less than approximately 0.57 inches, and wherein said first bead is raised above a substantially horizontal surface of said central panel a height. In one embodiment, the tear panel comprises a rounded, triangular shape, wherein said interconnection point is positioned proximate to an upper portion of said rounded, triangular-shaped tear panel, and wherein a lower portion of said rounded, triangular-shaped tear panel comprises a fourth radius of curvature that is substantially the same as a radius of curvature of said perimeter of said central panel.

Various methods of forming an end closure with improved pouring features are provided. In one embodiment, a method of manufacturing a metallic end closure adapted for interconnection to a neck of a container is provided comprising: providing a sheet metal material; cutting a disc from said sheet metal material; and forming said disc into said metallic end closure, wherein said metallic end closure comprises: a peripheral curl adapted for interconnection to said neck of said container; a chuck wall extending downwardly from said peripheral curl; a countersink interconnected to a lower end of said chuck wall; an inner panel wall extending upwardly from an interior portion of said countersink; a central panel interconnected to an upper portion of said inner panel wall, said central panel having a center point; a ring pull tab having a nose end and a tail end; and a score line in said central panel which defines a tear panel, wherein said tail end of said ring pull tab is positioned above said tear panel, and wherein said ring pull tab is operably interconnected to said tear panel at an interconnection point located a forward distance from said center point of the central panel. In some embodiments, the method may further comprise forming a first bead positioned proximate to one side of said score line; and forming a second bead positioned proximate to an opposite side of said score line.

Additional or alternative methods of forming an end closure with improved pouring features are also provided herein. In one embodiment, a method is provided comprising the steps of: providing a metallic end closure comprising: a peripheral curl which is adapted for interconnection to a neck of a beverage container; a countersink; an inner panel wall extending upwardly from the countersink; a central panel interconnected to an upper portion of the inner panel wall, the central panel having a center point; a ring pull tab having a nose end and a tail end, wherein the ring pull tab is operably interconnected to the central panel at an interconnection point and the interconnection point is a distance from the center point; and a score line in the central panel which defines a tear panel, wherein the tail end of the ring pull tab is positioned above the tear panel.

Various methods of forming an end closure with improved pouring features are provided. In one embodiment, a method of manufacturing a metallic end closure adapted for interconnection to a neck of a container is provided, comprising: providing a sheet metal material; cutting a blank from said sheet metal material; and forming said blank into said metallic end closure, wherein said metallic end closure comprises: a peripheral curl adapted for interconnection to said neck of said container; a chuck wall extending downwardly from said peripheral curl; a countersink interconnected to a lower end of said chuck wall; an inner panel wall extending upwardly from an interior portion of said countersink; a central panel having a perimeter and a center point which is located at an intersection of a vertical axis and a horizontal axis, wherein said perimeter of said central panel is interconnected to an upper portion of said inner panel wall; a score line in said central panel which defines a tear panel, wherein said score line has a first linear portion on a first side of said vertical axis and a second linear portion on a second side of said vertical axis; and a ring pull tab having a nose end and a tail end, wherein said tail end of said ring pull tab is positioned above said tear panel, and wherein said ring pull tab is operably interconnected to said tear panel at an interconnection point positioned proximate to an intersection of the first linear portion and the second linear portion of said score line.

In further embodiments, said tear panel is completely detachable from said central panel. Additionally, the method further comprises: forming a first bead positioned proximate to said first linear portion of said score line, wherein said first bead includes a linear portion which is substantially parallel to said first linear portion of said score line; and forming a second bead positioned proximate to said second linear portion of said score line, wherein said second bead includes a linear portion which is substantially parallel to said second linear portion of said score line, wherein said first bead and said second bead increase rigidity of said central panel. In a further embodiment, said first bead has a length and a width, wherein said length of said first bead is longer than said width of said first bead, and wherein said first bead is raised above a substantially horizontal surface of said central panel a height of at least about 0.025 inches and 0.035 inches. In some embodiments, the method further comprises forming a third bead positioned on said vertical axis between said interconnection point and said center point of said central panel. Further, the tear panel defines a pour opening of at least about 1.05 square inches.

In one embodiment, a method of opening a beverage container with a ring pull and improved pouring features is provided. The method comprises: pulling a tail end of a ring pull tab upwardly and away from the user; positioning the ring pull tab in a vertical position to fracture a score line; pulling the tail end of the ring pull tab back toward the user; completely detaching the ring pull tab and tear panel from the end closure.

For purposes of further disclosure, the following references generally related to end closures and ring pulls are hereby incorporated by reference in their entireties:

Chinese Patent Publication Number CN103287663A;

Chinese Patent Publication Number CN103029888A;

European Patent No. EP0040277 to Kaneko; and

U.S. Pat. No. 3,441,168 issued to Luviano on Apr. 29, 1969.

For purposes of further disclosure, the following references generally related to end closure panels and SOTs are hereby incorporated by reference in their entireties:

Japanese Patent Publication Number JP2002145263 to Yoshihiko;

Japanese Patent Publication Number JP2000159229 to Yoshihiko;

U.S. Pat. No. 5,829,623 issued to Otsuka et al. on Nov. 3, 1998; and

U.S. Pat. No. 8,157,119 issued to Watson et al. on Apr. 17, 2012.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about".

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. §112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of the invention.

FIG. 5A is a cross-sectional elevation view of a traditional SOT end closure;

FIG. 5B is a cross-sectional elevation view of the end closure of FIG. 4 taken at line 5B-5B;

Figure 1:
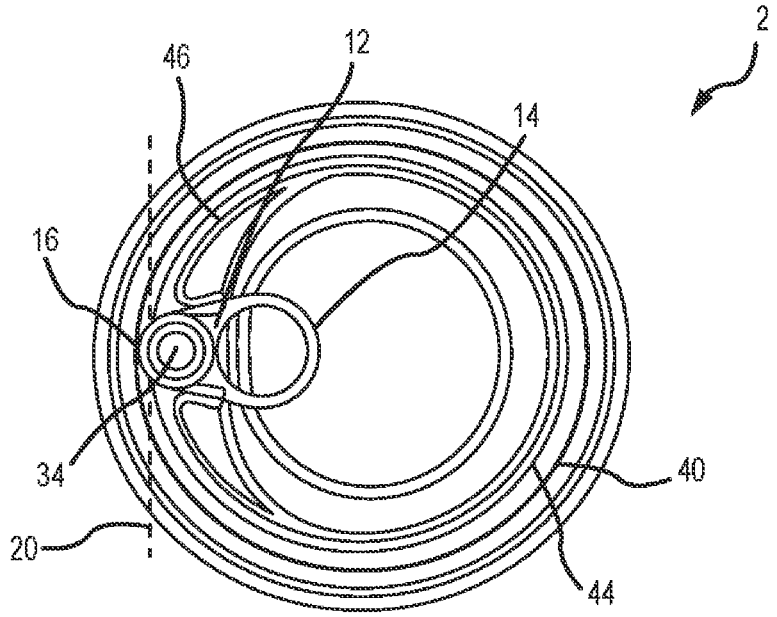
FIG. 1 PRIOR ART
FIG. 1 is a top plan view of the public side of a prior art end closure.

To assist in the understanding of the embodiments of the present invention the following list of components and associated numbering found in the drawings is provided herein:

2 End Closure
4 Central Panel
8 Hinge Line
12 Tab/Ring Pull
14 Tab Tail
16 Tab Nose
20 Chord
22 Tab Interconnection Point
24 Peripheral Curl
26 Chuck Wall
28 Countersink
30 Countersink Outer Panel Wall
32 Countersink Inner Panel Wall
34 Rivet
40 Score Line
42 Tear Panel/Pour Opening
44 Circumferential Bead
46 Wing-shaped Bead
48 Linear Bead
50 Bead
52 Tab Bead
H1 Countersink Depth (Height Countersink to Curl)
H2 Curl Height
L1 Curl Diameter
L2 Distance from Center Point to Rivet Center
R1 First Radius of Curvature
R2 Second Radius of Curvature
R3 Third Radius of Curvature
R4 Fourth Radius of Curvature It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

FIGS. 1-7 show various embodiments of an end closure with a very large opening. In some embodiments, the end closure is a 202 B-64 very large opening end closure with a ring pull. In other embodiments, the end closure is a 206 B-64 very large opening end closure with a ring pull. In some embodiments, the end closure is made of an aluminum alloy. The end closure can resist buckling when the internal pressure of the contents is 620.5 KPA (90 PSI) or greater and may even resist buckling when the internal pressure of the contents is 634.3 KPA (92 PSI) or greater. Before seaming, between about 22 and 26 end closures may be stacked every 2 inches for shipping and throughout the manufacturing and filling processes.

FIG. 1 is a top plan view of the public side of a prior art full panel opening end closure 2 with a ring pull according to one embodiment of the prior art. The end closure illustrated in FIG. 1 has a number of disadvantages. For example, while it does achieve a satisfactory pressure performance, its opening performance is not great primarily due to the short length of the chord 20 between the two points where the chord 9 intersects with the score 40. This is caused by the presence of a circumferential strengthening bead 44 between the nose portion 16 of the tab 12 and the score 40. The circumferential bead 44 tends to prevent an initial fracture of the score 40, induced when the tab 12 is raised, from propagating around the score 44 to a sufficient extent. A solution to this problem is to terminate the circumferential bead 44 on each side of the tab 12 to provide a break in the circumferential bead 44 in the region behind the tab 12. However, merely terminating the circumferential bead 44 results in an increased risk of peaking along the score line 40 in the region of the break in the circumferential bead 44. A further solution that has been proposed is to maintain the circumferential bead 44 as shown in FIG. 1 and introduce an additional pair of relatively short beads on either side of the rivet 34, see European Patent No. EP 1577222, which is incorporated by reference herein in its entirety. These beads project outwardly from the rivet region in a generally circumferential direction. The additional beads provide a fold line about which the closure tends to fold when the tab 12 is raised, counteracting the strengthening effect of the circumferential bead 44.

Figure 2:
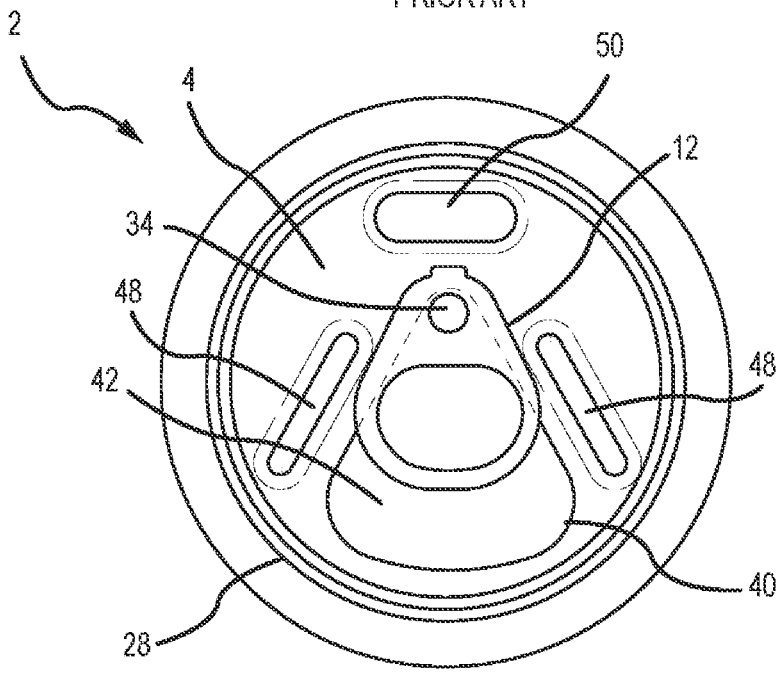
FIG. 2 is a top plan view of the public side of an end closure with a pull ring tab according to a first embodiment of the present invention.

FIG. 2 is a top plan view of the public side of an end closure 2 according to a first embodiment of the present invention. The end closure may include a central panel 4, a score line 40 defining a score panel (also called a tear panel herein) 42, and a tab or ring pull tab 12. In some embodiments the tab 12 is interconnected by a rivet 34, which may be same material as central panel 4. The tab 12 can be a SOT or a ring pull tab in various embodiments. Thus, the tab 12 can be interconnected to the central panel 4 via a rivet for a SOT or the tab 12 can be interconnected to the tear panel 42 via a rivet for a ring pull tab. The rivet 34 is offset from center point of the central panel 4 and, in order to accommodate the size of the tab 12, the lift end of the tab 12 is positioned over the tear panel 42. Further, the nose of the tab 12 is positioned proximate to an upper portion of the tear panel 42, i.e., the portion of the tear panel 42 proximate to the 12 o'clock position. In some embodiments, the nose of the tab 12 extends beyond the tear panel 42. Having a rivet 34 offset from the center point of the central panel 4 allows the tear panel 42 to be larger than tear panels in traditional end closures. Additionally, the tear panel 42 shown has a rounded, triangular shape or a tear drop shape. The shape of the tear panel 42 accommodates one or more beads 48, 50. In the embodiment shown, the end closure 2 comprises two linear beads 48 approximately parallel to straight portions of the tear panel 42 and one bead 50 positioned at the top (12 o'clock) of the central panel 4. The two linear beads 48, and their location close to and parallel with a portion of the score 40, add rigidity to the central panel 4 to allow the score line 40 to tear open more easily by lowering the pop force needed to open the tear panel 42. Further, the linear beads 48 prevent the score line 40 from flexing rather than tearing. The linear beads 48 parallel to the straight portions of the tear panel 42 may also strengthen the end closure 2 in the region of the score 40, tending to prevent unintended fracturing of the score 40. In some embodiments, the beads 48 may follow a generally linear path in the region approaching the rivet 34 such that when the tab 12 is lifted away from the central panel 4, a fold in the central panel 4 is created along that generally linear path. Additionally, the exact location at which the bead (or beads) 48 terminates may depend upon a number of factors. Thus, the termination location may be slightly before or after a witness periphery or may coincide with the periphery.

The beads 48, 50 can either be raised above the surface of the central panel 4 or lowered below the surface of the central panel 4. The end closure 2 can include any number of beads, 48, 50. Thus, the end closure 2 can have one linear bead 48, one linear bead and one bead 50, only one bead 50, two linear beads 48, two linear beads 48 and a bead 50, and so on. Furthermore, the shapes of the beads 48, 50 can vary depending on the embodiment and specific requirements of the end closure 2. For example, the linear beads 48 may be circular or square-shaped rather than a long oval shape as shown in FIG. 2. Further, the bead 50 can be shaped similar to the linear beads 48 or can be more circular or even square-shaped. Thus, the beads 48, 50 can be any shape or size depending on the specific embodiment.

Figure 3:
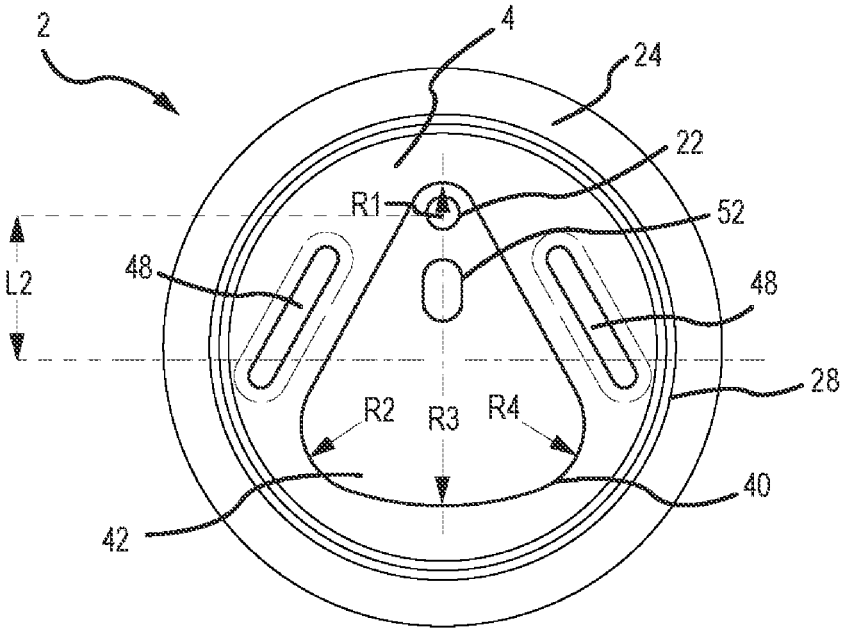
FIG. 3 is a top plan view of the public side of an end closure without a tab according to a second embodiment of the present invention.

FIG. 3 is a top plan view of the public side of an end closure 2 shown without a pull ring tab according to a second embodiment of the present invention. The end closure 2 may include a central panel 4, a score line 40 defining a tear panel 42, one or more beads 48, 52, a countersink 28, and a peripheral curl 24. The tab is interconnected to the central panel 4 at a tab interconnection point 22. The tab interconnection point 22 is positioned along the vertical centerline (also called the vertical axis herein) of the end closure 2, but is not positioned on the horizontal centerline (also called the horizontal axis herein) of the end closure 2. In one embodiment, distance L2 of the tab interconnection point 22 from the center point of the central panel 4 is between about 12.06 mm (0.475 inches) and about 16.06 mm (0.632 inches). In a preferred embodiment, the distance L2 is between about 13.06 mm (0.514 inches) and about 15.06 mm (0.593 inches). In a more preferred embodiment, the distance L2 is about 14.06 mm (0.5534 inches). Thus, the tab interconnection point 22 is offset from the center point of the central panel 4, which allows the tear panel 42 to be larger than tear panels in traditional end closures.

Additionally, the tear panel 42 shown has a rounded, triangular shape or a tear drop shape. The tear panel 42 has a vertical length extending along the vertical centerline of the end closure 2 of about 1.355 inches. Additionally, the tear panel 42 has two substantially linear sides (also called linear legs herein), one on either side of the vertical centerline, a curved bottom portion, and one or more radii of curvature R1, R2, R3, R4. The substantially linear sides have substantially the same length, which is about 0.917 inches. The first radius of curvature R1 of the tear panel 42 is proximate to the tab interconnection point 22, between the first substantially linear side and the second substantially linear side, and is between about 0.100 inches and about 0.200 inches. The second radius of curvature R2 is proximate to a lower left-hand portion of the tear panel 42, between the first substantially linear side and the curved bottom, and is between about 0.270 inches and about 0.310 inches. The third radius of curvature R3 is proximate to a lower center portion of the tear panel 42, between the second substantially linear side and the curved bottom, and is between about 1.00 inches and about 1.40 inches. Further, the third radius of curvature R3 is larger than the radius of curvature of the central panel 4 (i.e., the perimeter or peripheral edge of the central panel 4), which allows the tear panel 42 to be positioned farther from the central panel 4 perimeter or peripheral edge than other embodiments (e.g., FIGS. 2 and 6). Additionally, the second embodiment of the end closure 2 (FIG. 3) does not include a bead positioned proximate to the 12 o'clock position of the central panel 4, which allows the tab interconnection point 22 to be further from the center point of the end closure 2 than the first embodiment (FIG. 2). The fourth radius of curvature R4 is proximate to a lower right-hand portion of the tear panel 42 and is between about 0.270 inches and about 0.310 inches. In some embodiments, the second radius of curvature R2 and the fourth radius of curvature R4 are substantially the same. Furthermore, in this embodiment, the area of the opening (formed by the tear panel 42) is between about 35% and 45% of the total surface area of the central panel 4. In a preferred embodiment, the area of the opening is between about 40% and 42% of the total surface area of the central panel 4. In a more preferred embodiment, the area of the opening is about 41% of the total surface area of the central panel 4. Thus, in one embodiment, the pour opening may have an area between about 1.040 sq. in. and about 1.060 sq. in. In a preferred embodiment, the end closure may have a pour opening with an area of about 1.05036 sq. in.

The shape of the tear panel 42 also accommodates one or more beads 48, 52 or forms. In the embodiment shown, the end closure 2 comprises two linear beads 48 approximately parallel to a portion of the tear panel 42, which can be a straight portion of the tear panel 42. The two linear beads 48, and their location close to and substantially parallel with a linear portion of the score 40, add rigidity to the central panel 4 to allow the score line 40 to tear open more easily by lowering the pop force needed to open the tear panel 4. Further, the linear beads 48 prevent the score line 40 from flexing rather than tearing. The linear beads 48 can also strengthen the end closure 2 in the region of the score 40, tending to prevent unintended fracturing of the score 40. In some embodiments, the beads 48 may follow a generally linear path in the region approaching the tab interconnection point 22 such that when the tab 12 is lifted away from the central panel 4, a fold in the central panel 4 is created along that generally linear path. Additionally, the exact location at which the bead (or beads) 48 terminates may depend upon a number of factors. Thus, the termination location may be slightly before or after a witness periphery or may coincide with the periphery.

The end closure 2 may also comprise a bead 52, form, protuberance, or tamper indicator under the tab 12. In the embodiment shown, the end closure 4 comprises a tab bead 52 positioned between the tab interconnection point 22 and the center point of the end closure 2. In some embodiments, the bead 52 has an oval shape and is oriented with its long axis positioned radially from the center of the end closure 2. Thus, the bead 52 is positioned along the vertical axis of the end closure 2. In one embodiment, the tab bead 52 is raised above the surface of the central panel 4 a height between about 0.010 inches and about 0.050 inches. In a preferred embodiment, the tab bead 52 is raised above the surface of the central panel 4 a height between about 0.023 inches (0.58 mm) and about 0.033 inches (0.83 mm). In more preferred embodiment, the tab bead 52 is raised above the surface of the central panel 4 a height between about 0.025 inches (0.63 mm) and about 0.031 inches (0.78 mm).

The beads 48, 52 can either be raised above the surface of the central panel 4 or lowered below the surface of the central panel 4. The end closure 2 can include any number of beads, 48, 52. Thus, the end closure 2 can have one linear bead 48, one linear bead and one tab bead 52, only one tab bead 52, two linear beads 48, two linear beads 48 and a tab bead 52, and so on. Furthermore, the shapes of the beads 48, 52 can vary depending on the embodiment and specific requirements of the end closure 2. For example, the linear beads 48 may be circular or square-shaped rather than a long oval shape as shown in FIG. 3. Further, the tab bead 52 can be shaped similar to the linear beads 48 or can be more circular or even square-shaped. Thus, the beads 48, 52 can be any shape or size depending on the specific embodiment.

In some embodiments, the bead 52, form, protuberance, or tamper indicator may elevate the pull ring of the tab 12 and provide a user with finger access to the pull ring. Thus, in one embodiment, the protuberance or form 52 may be flat before the end closure 2 is interconnected to the container body and the protuberance or form 52 may pop up after the end closure 2 is sealed onto the pressurized container. Thus, the protuberance or form 52 will not interfere with stacking and shipping, but it will assist the user in opening the end closure 2. The form or bead 52 under the tab 12 may additionally add rigidity to the tear panel 42 and lower the pop force needed to open the tear panel 42. The form or bead 52 may be positioned above the center point of the central panel 4 and below the rivet or the tab interconnection point 22. In addition to the bead 52 or as an alternative to the bead 52, the end closure 2 may include a finger access panel under the tab 12.

In some embodiments, a tamper indicator may be provided on the end closure 2. Thus, if the end closure 2 is used with containers for food, the bead 52 or protuberance may be pulled inwardly after filling and cooling when a vacuum is created in the container. If the container is compromised during shipping or handling, the bead 52 acts as a tamper indicator and will be raised upwardly, indicating that the container is no longer in a vacuum. The tamper indicator could be positioned anywhere on the end closure 2 and could be positioned under the tab 12 to raise the tab 12 as a further indicator to the consumer. As previously mentioned, the tamper indicator pops up if the container has been opened or some pressure has been released. This is especially important in vacuum packed products such as infant formula and nutraceuticals.

Figure 4:
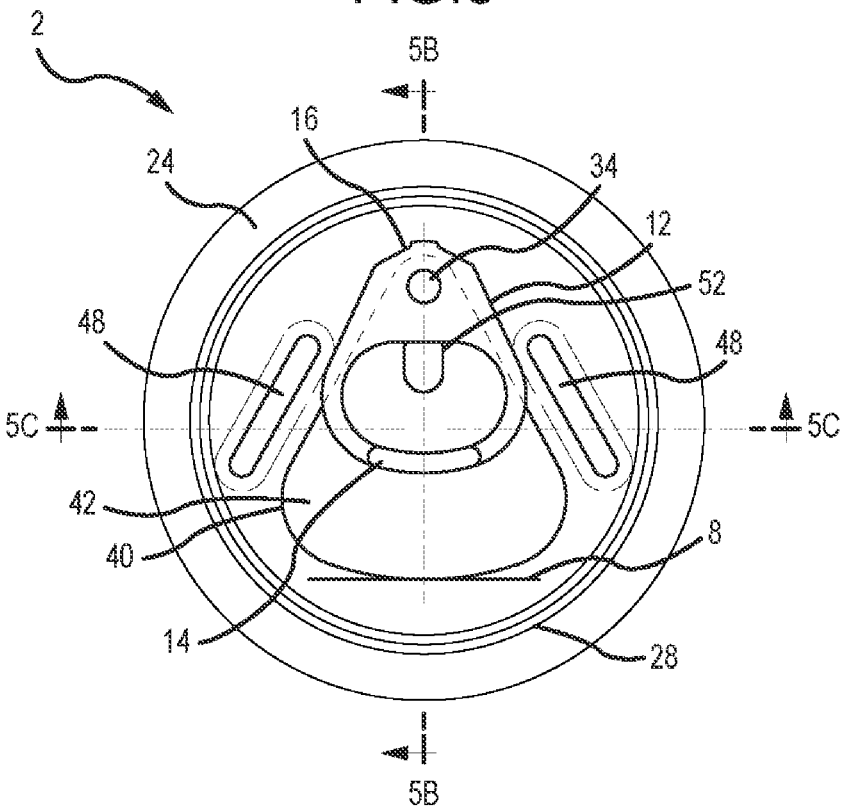
FIG. 4 shows the end closure of FIG. 3 with a pull ring tab.

FIG. 4 shows the end closure according to the second embodiment with a pull ring tab 12. The pull ring tab 12 has a tab tail (or lift end) 14 and a nose 16 opposite the tail 14. The pull ring tab 12 can be interconnected to the tear panel 42 and be completely detachable with the tear panel 42, i.e., it is not a SOT. In one embodiment, the pull ring tab 12 is interconnected to the tear panel 42 by a rivet 34, which may be the same material as the central panel 4. In other embodiments, the tab 12 is interconnected to the central panel 4 via a rivet for a SOT. In some embodiments, the rivet 34 is positioned along a vertical axis of the end closure 2 and is offset from center point of the central panel 4. Additionally, the lift end of the tab 12 is positioned over the tear panel 42 in order to accommodate the size of the tab 12 and such that the tab 12 fits within the perimeter (i.e., the peripheral edge) of the central panel 4. Further, the nose of the tab 12 is positioned proximate to an upper portion of the tear panel 42, i.e., the portion of the tear panel 42 proximate to the 12 o'clock position. In some embodiments, the nose of the tab 12 extends beyond the tear panel 42. FIG. 4 also shows a tab bead 52 positioned on the vertical centerline of the end closure 2.

In an alternate embodiment, FIG. 4 may be an end closure with an offset rivet and a SOT. Thus, the tear panel may not completely tear off and may instead bend at a hinge line 8 shown in FIG. 4. In the SOT embodiment, the tail end 14 of the pull tab 12 is positioned above the tear panel 42 and the hinge 8 on the tear panel 42 is positioned at the bottom (6 o'clock position) of the opening. Accordingly, a user may open the container by pulling the tab 12 upwardly and away from the user until the tab 12 is in a vertical position, then pull the tab 12 back toward the user and push the tab 12 and tear panel 42 into the container, bending the tear panel 42 at the hinge 8.

FIG. 5A shows a cross-sectional view of a traditional end closure with a SOT. The end closure comprises a tab 12 interconnected to the central panel 4 via a rivet 34 positioned at approximately the center of the central panel 4. The end closure further comprises a peripheral curl 24, a chuck wall 26, and a countersink 28 having an inner panel wall 32 and an outer panel wall 30.

Figure 5B:
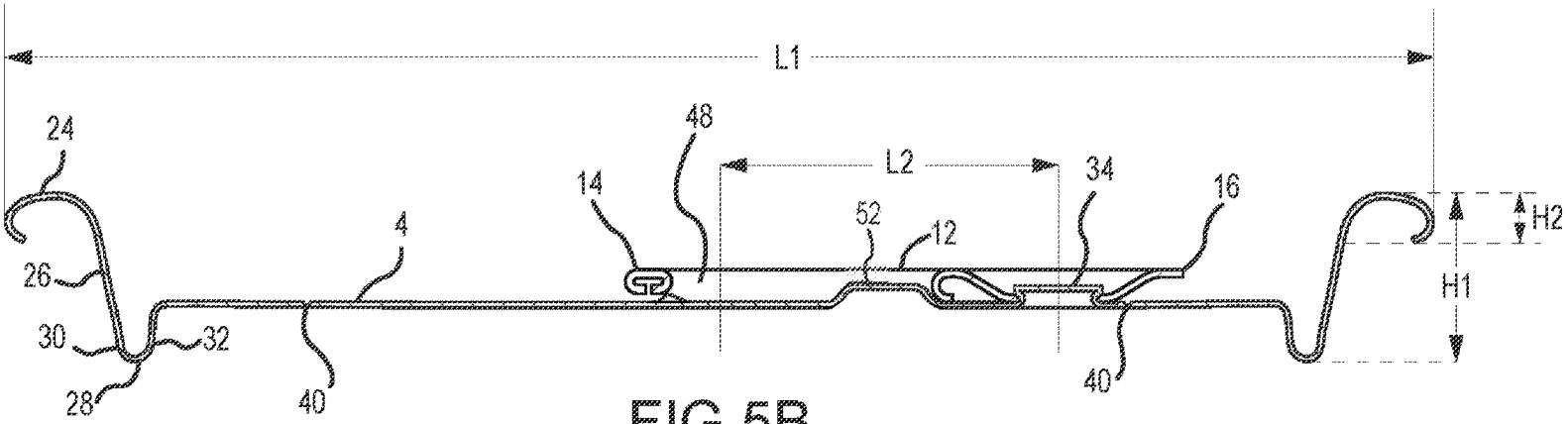
FIG. 5B-B is a cross-sectional elevation view of the end closure of FIG. 4 taken along a jagged cut line.

FIG. 5B-B is a cross-sectional elevation view of the end closure 2 of FIG. 4 taken at a jagged cut line. The end closure comprises a peripheral curl 24 interconnected on a lower end to a chuck wall 26, which is interconnected on a lower end to an outer panel wall 30 of the counter sink 28. The counter sink 28 also includes an inner panel wall 32, which is interconnected on an upper end to the central panel 4. In one embodiment, the curl height H2 is between about 1.53 mm (0.060 inches) and about 2.53 mm (0.100 inch). In a preferred embodiment, the curl height H2 is between about 1.90 mm (0.075 inches) and about 2.16 mm (0.085 inches). In a more preferred embodiment, the curl height H2 is about 2.03 mm (0.080 inches). In one embodiment, the countersink depth H1 (i.e., the height from the countersink 28 to the top of the peripheral curl 24) is between about 6.36 mm (0.250 inches) and about 7.36 mm (0.290 inches). In a preferred embodiment, the countersink depth H1 is between about 6.73 mm (0.265 inches) and about 6.99 mm (0.275 inches). In a more preferred embodiment, the countersink depth H1 is about 6.86 mm (0.270 inches).

The central panel 4 comprises a score line 40 defining a tear panel, a tab 12 interconnected to the central panel 4 via a rivet 34, and a linear bead 48. The tab 12 has a tail end 14 positioned over the tear panel and has a nose end 16 positioned opposite the tail end 14. The score 40 can have a score residual between about 0.0024 inches and about 0.0075 inches in one embodiment. In a preferred embodiment, the score 40 has a score residual between about 0.0034 inches and about 0.0065 inches. In a more preferred embodiment, the score 40 has a score residual between about 0.0044 inches and about 0.0055 inches. The rivet 34 is positioned a distance L2 from the center point of the central panel 4. In one embodiment, distance L2 of the rivet 34 from the center point of the central panel 4 is between about 12.06 mm (0.475 inches) and about 16.06 mm (0.632 inches). In a preferred embodiment, the distance L2 is between about 13.06 mm (0.514 inches) and about 15.06 mm (0.593 inches). In a more preferred embodiment, the distance L2 is about 14.06 mm (0.5534 inches).

In one embodiment, the curl diameter L1 is between approximately 58.44 mm (2.300 inches) and approximately 60.44 mm (2.380 inches). In a preferred embodiment, the curl diameter L1 is between approximately 59.19 mm (2.330 inches) and approximately 59.69 mm (2.350 inches). In a more preferred embodiment, the curl diameter L1 is approximately 59.44 mm (2.340 inches). In another embodiment, the curl diameter L1 is between approximately 63.77 mm (2.510 inches) and approximately 65.77 mm (2.590 inches). In a preferred embodiment, the curl diameter L1 is between approximately 64.516 mm (2.540 inches) and approximately 65.024 mm (2.560 inches). In a more preferred embodiment, the curl diameter L1 is approximately 64.77 mm (2.550 inches).

Additionally, at least one linear bead 48 is shown in FIG. 5B-B. The linear beads 48 can be either raised above the surface of the central panel 4 or the linear beads 48 can be lowered below the surface of the central panel 4. In one embodiment, the linear bead 48 is raised above the surface of the central panel 4 or is lowered below the surface of the central panel 4 a height between about 0.010 inches and 0.050 inches. In a preferred embodiment, the linear bead 48 is raised above the surface of the central panel 4 or is lowered below the surface of the central panel 4 a height between about 0.025 inches (0.63 mm) and 0.035 inches (0.89 mm). The linear beads 48 can vary in length depending on the requirements of the end closure. In one embodiment, the linear bead 48 is between about 0.450 inches and about 0.690 inches long. In a preferred embodiment, the linear bead 48 is between about 0.550 inches and about 0.590 inches long. In a more preferred embodiment, the linear bead 48 is about 0.5693 inches long.

FIG. 5B is a cross-sectional elevation view of the end closure 2 of FIG. 4 taken at a line 5B-5B. The end closure comprises a peripheral curl 24 interconnected on a lower end to a chuck wall 26, which is interconnected on a lower end to an outer panel wall 30 of the counter sink 28. The counter sink 28 also includes an inner panel wall 32, which is interconnected on an upper end to the central panel 4. In one embodiment, the curl height H2 is between about 1.53 mm (0.060 inches) and about 2.53 mm (0.100 inch). In a preferred embodiment, the curl height H2 is between about 1.90 mm (0.075 inches) and about 2.16 mm (0.085 inches). In a more preferred embodiment, the curl height H2 is about 2.03 mm (0.080 inches). In one embodiment, the countersink depth H1 (i.e., the height from the countersink 28 to the top of the peripheral curl 24) is between about 6.36 mm (0.250 inches) and about 7.36 mm (0.290 inches). In a preferred embodiment, the countersink depth H1 is between about 6.73 mm (0.265 inches) and about 6.99 mm (0.275 inches). In a more preferred embodiment, the countersink depth H1 is about 6.86 mm (0.270 inches).

The central panel 4 comprises a score line 40 defining a tear panel, a tab 12 interconnected to the central panel 4 via a rivet 34, and a bead 52. The tab 12 has a tail end 14 positioned over the tear panel and has a nose end 16 positioned opposite the tail end 14. The score 40 can have a score residual between about 0.0024 inches and about 0.0075 inches in one embodiment. In a preferred embodiment, the score 40 has a score residual between about 0.0034 inches and about 0.0065 inches. In a more preferred embodiment, the score 40 has a score residual between about 0.0044 inches and about 0.0055 inches. The rivet 34 is positioned a distance L2 from the center point of the central panel 4. In one embodiment, distance L2 of the rivet 34 from the center point of the central panel 4 is between about 12.06 mm (0.475 inches) and about 16.06 mm (0.632 inches). In a preferred embodiment, the distance L2 is between about 13.06 mm (0.514 inches) and about 15.06 mm (0.593 inches). In a more preferred embodiment, the distance L2 is about 14.06 mm (0.5534 inches).

The bead 52 is positioned along the vertical centerline of the end closure 2. In one embodiment, the tab bead 52 is raised above the surface of the central panel 4 a height between about 0.010 inches and about 0.050 inches. In a preferred embodiment, the tab bead 52 is raised above the surface of the central panel 4 a height between 0.023 inches (0.58 mm) and about 0.033 inches (0.83 mm). In more preferred embodiment, the tab bead 52 is raised above the surface of the central panel 4 a height between about 0.025 inches (0.63 mm) and about 0.031 inches (0.78 mm).

Figure 5C:
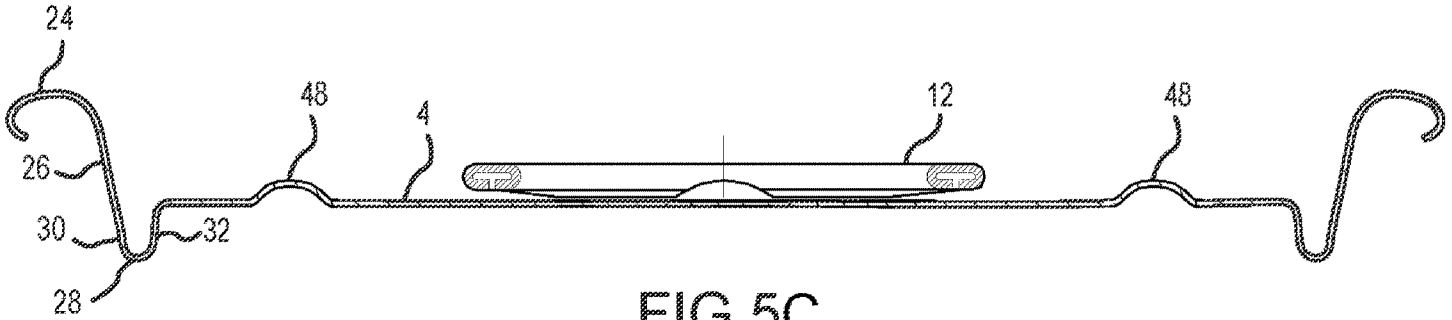
FIG. 5C is a cross-sectional elevation view of the end closure of FIG. 4 taken at line 5C-5C.

FIG. 5C is a cross-sectional elevation view of the end closure 2 of FIG. 4 taken at line 5C-5C. The end closure 2 comprises a central panel 4 with a tab 12 and two linear beads 48. The linear beads 48 can be either raised above the surface of the central panel 4 or the linear beads 48 can be lowered below the surface of the central panel 4. In one embodiment, the linear bead 48 is raised above the surface of the central panel 4 or is lowered below the surface of the central panel 4 a height between about 0.010 inches and 0.050 inches. In a preferred embodiment, the linear bead 48 is raised above the surface of the central panel 4 or is lowered below the surface of the central panel 4 a height between about 0.025 inches (0.63 mm) and 0.035 inches (0.89 mm).

Figure 6:
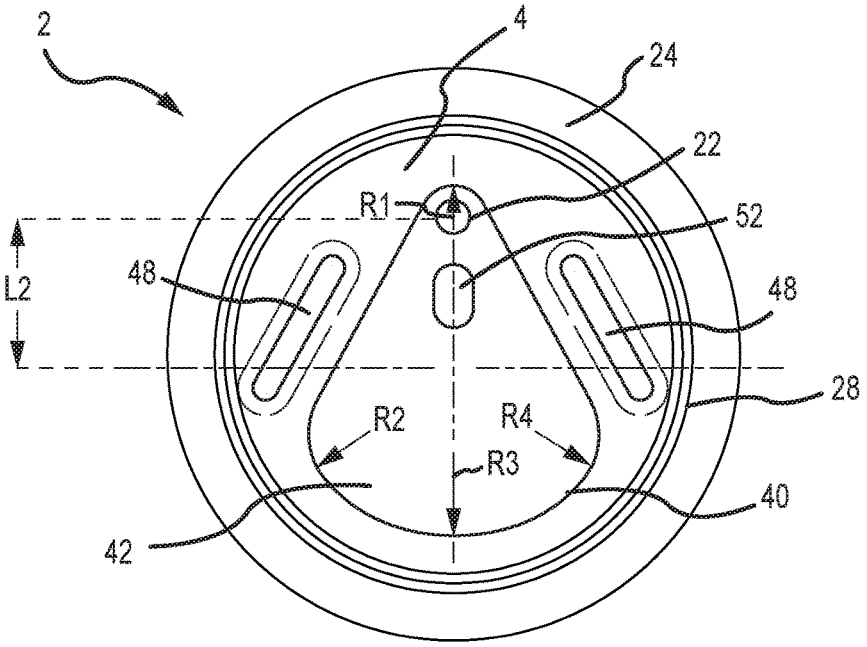
FIG. 6 is a top plan view of the public side of an end closure without a tab according to a third embodiment of the present invention.

FIG. 6 is a top plan view of the public side of an end closure 2 shown without a pull ring tab according to a third embodiment of the present invention. The end closure 2 may include a central panel 4, a score line 40 defining a tear panel 42, one or more beads 48, 52, a countersink 28, and a peripheral curl 24. The tab (not shown) is interconnected to the central panel 4 at a tab interconnection point 22. The tab interconnection point 22 is positioned along the vertical axis of the end closure 2, but is not positioned on the horizontal axis of the end closure 2. In one embodiment, distance L2 of the tab interconnection point 22 from the center point of the central panel 4 is between about 12.06 mm (0.475 inches) and about 16.06 mm (0.632 inches). In a preferred embodiment, the distance L2 is between about 13.06 mm (0.514 inches) and about 15.06 mm (0.593 inches). In a more preferred embodiment, the distance L2 is about 14.06 mm (0.5534 inches). Thus, the tab interconnection point 22 is offset from the center point of the central panel 4, which allows the tear panel 42 to be larger than tear panels in traditional end closures.

Additionally, the tear panel 42 shown has a rounded, triangular shape or a tear drop shape. The tear panel 42 has a vertical length extending along the vertical centerline of the end closure 2 about 1.425 inches. Additionally, the tear panel 42 has two substantially linear sides (or linear legs), one on either side of the vertical centerline, a curved bottom portion, and one or more radii of curvature R1, R2, R3, R4. The substantially linear sides have substantially the same length, which is about 0.917 inches. The first radius of curvature R1 of the tear panel 42 is proximate to the tab interconnection point 22, between the first substantially linear side and the second substantially linear side, and is between about 0.100 inches and about 0.160 inches. The second radius of curvature R2 is proximate to a lower left-hand portion of the tear panel 42 and is between about 0.250 inches and about 0.310 inches. The third radius of curvature R3 is proximate to a lower center portion of the tear panel 42 and is between about 0.650 inches and about 0.850 inches. Further, the third radius of curvature R3 is substantially the same as the radius of curvature of the central panel 4 (i.e., the perimeter or peripheral edge of the central panel 4), which allows the tear panel 42 to be larger than other embodiments (e.g., FIGS. 2 and 3). Thus, the lower portion of the tear panel 42 is substantially parallel to the perimeter of the central panel 4. Additionally, the third embodiment of the end closure 2 (FIG. 6) does not include a bead positioned proximate to the 12 o'clock position of the central panel 4 (i.e., between the tab interconnection point 22 and the perimeter of the central panel 4 at the 12 o'clock position), which allows the tab interconnection point 22 to be further from the center point of the end closure 2 than the first embodiment of the end closure (FIG. 2). The fourth radius of curvature R4 is proximate to a lower right-hand portion of the tear panel 42 and is between about 0.250 inches and about 0.310 inches. In some embodiments, the second radius of curvature R2 and the fourth radius of curvature R4 are substantially the same. Furthermore, in this embodiment, the area of the opening (formed by the tear panel 42) is between about 38% and 48% of the total surface area of the central panel 4. In a preferred embodiment, the area of the opening is between about 42% and 44% of the total surface area of the central panel 4. In a more preferred embodiment, the area of the opening is about 43.3% of the total surface area of the central panel 4. Thus, in one embodiment, the pour opening may have an area between about 0.960 sq. in. and about 1.225 sq. in. In a preferred embodiment, the pour opening may have an area between about 1.000 sq. in. and about 1.185 sq. in. In a preferred embodiment, the end closure may have a pour opening with an area of about 1.093 sq. in.

The shape of the tear panel 42 also accommodates one or more beads 48, 52 or forms. In the embodiment shown, the end closure 2 comprises two linear beads 48 approximately parallel to a portion of the tear panel 42, which can be a straight portion of the tear panel 42. The two linear beads 48, and their location close to and substantially parallel with a linear portion of the score 40, add rigidity to the central panel 4 to allow the score line 40 to tear open more easily by lowering the pop force needed to open the tear panel 4. Further, the linear beads 48 prevent the score line 40 from flexing rather than tearing. The linear beads 48 can also strengthen the end closure 2 in the region of the score 40, tending to prevent unintended fracturing of the score 40. In some embodiments, the beads 48 may follow a generally linear path in the region approaching the tab interconnection point 22 such that when the tab 12 is lifted away from the central panel 4, a fold in the central panel 4 is created along that generally linear path. Additionally, the exact location at which the bead (or beads) 48 terminates may depend upon a number of factors. Thus, the termination location may be slightly before or after a witness periphery or may coincide with the periphery.

The end closure 2 may also comprise a bead 52, form, protuberance, or tamper indicator under the tab 12. In the embodiment shown, the end closure 4 comprises a tab bead 52 positioned between the tab interconnection point 22 and the center point of the end closure 2. In some embodiments, the bead 52 has an oval shape and is oriented with its long axis positioned radially from the center of the end closure 2. Thus, the bead 52 is positioned along the vertical centerline of the end closure 2. In one embodiment, the tab bead 52 is raised above the surface of the central panel 4 a height between about 0.010 inches and about 0.050 inches. In a preferred embodiment, the tab bead 52 is raised above the surface of the central panel 4 a height between 0.023 inches (0.58 mm) and about 0.033 inches (0.83 mm). In more preferred embodiment, the tab bead 52 is raised above the surface of the central panel 4 a height between about 0.025 inches (0.63 mm) and about 0.031 inches (0.78 mm).

The beads 48, 52 can either be raised above the surface of the central panel 4 or lowered below the surface of the central panel 4. The end closure 2 can include any number of beads, 48, 52. Thus, the end closure 2 can have one linear bead 48, one linear bead and one tab bead 52, only one tab bead 52, two linear beads 48, two linear beads 48 and a tab bead 52, and so on. Furthermore, the shapes of the beads 48, 52 can vary depending on the embodiment and specific requirements of the end closure 2. For example, the linear beads 48 may be circular or square-shaped rather than a long oval shape as shown in FIG. 6. Further, the tab bead 52 can be shaped similar to the linear beads 48 or can be more circular or even square-shaped. Thus, the beads 48, 52 can be any shape or size depending on the specific embodiment.

In some embodiments, the bead 52, form, protuberance, or tamper indicator may elevate the pull ring of the tab 12 and provide a user with finger access to the pull ring. Thus, in one embodiment, the protuberance or form 52 may be flat before the end closure 2 is interconnected to the container body and the protuberance or form 52 may pop up after the end closure 2 is sealed onto the pressurized container. Thus, the protuberance or form 52 will not interfere with stacking and shipping, but it will assist the user in opening the end closure 2. The form or bead 52 under the tab 12 may additionally add rigidity to the tear panel 42 and lower the pop force needed to open the tear panel 42. The form or bead 52 may be positioned above the center point of the central panel 4 and below the rivet or the tab interconnection point 22. In addition to the bead 52 or as an alternative to the bead 52, the end closure 2 may include a finger access panel under the tab 12.

In some embodiments, a tamper indicator may be provided on the end closure 2. Thus, if the end closure 2 is used with containers for food, the bead 52 or protuberance may be pulled inwardly after filling and cooling when a vacuum is created in the container. If the container is compromised during shipping or handling, the bead 52 acts as a tamper indicator and will be raised upwardly, indicating that the container is no longer in a vacuum. The tamper indicator could be positioned anywhere on the end closure 2 and could be positioned under the tab 12 to raise the tab 12 as a further indicator to the consumer. As previously mentioned, the tamper indicator pops up if the container has been opened or some pressure has been released. This is especially important in vacuum packed products such as infant formula and nutraceuticals.

Figure 7:
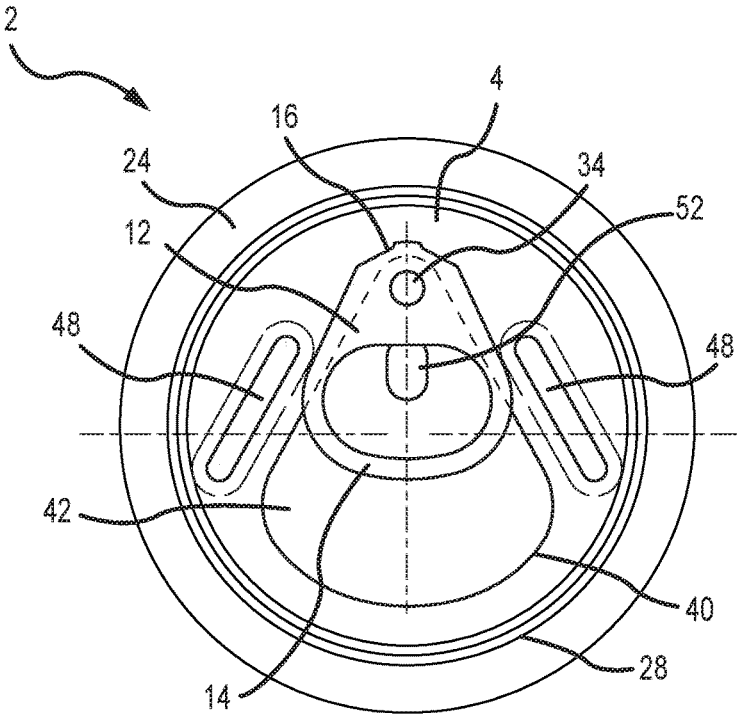
FIG. 7 shows the end closure of FIG. 6 with a pull ring tab.

FIG. 7 shows the end closure according to the third embodiment with a pull ring tab 12. The pull ring tab 12 has a tab tail (or lift end) 14 and a nose 16 opposite the tail 14. The pull ring tab 12 can be interconnected to the tear panel 42 and be completely detachable with the tear panel 42, i.e., it is not a SOT. In one embodiment, the pull ring tab 12 is interconnected to the tear panel 42 by a rivet 34, which may be the same material as the central panel 4. In other embodiments, the tab 12 is interconnected to the central panel 4 via a rivet for a SOT. In some embodiments, the rivet 34 is positioned along a vertical centerline of the end closure 2 and is offset from center point of the central panel 4. Additionally, the lift end of the tab 12 is positioned over the tear panel 42 in order to accommodate the size of the tab 12 and such that the tab 12 fits within the perimeter of the central panel 4. Further, the nose of the tab 12 is positioned proximate to an upper portion of the tear panel 42, i.e., the portion of the tear panel 42 proximate to the 12 o'clock position. In some embodiments, the nose of the tab 12 extends beyond the tear panel 42.

In an alternate embodiment (not shown), FIG. 7 may be an end closure with an offset rivet and a SOT. Thus, the tear panel may not completely tear off and may instead bend at a hinge line positioned at the bottom (6 o'clock position) of the tear panel 42. In the SOT embodiment, the tail end 14 of the pull tab 12 is positioned above the tear panel 42 and the hinge on the tear panel 42 is positioned at the bottom (6 o'clock position) of the opening. Accordingly, a user may open the container by pulling the tab 12 upwardly and away from the user until the tab 12 is in a vertical position, then pull the tab 12 back toward the user and push the tab 12 and tear panel 42 into the container, bending the tear panel 42 at the hinge.

It should be understood that in some embodiments the end closure does not have a countersink. In additional or alternative embodiments, the end closure may not have a peripheral curl. Further, the end closure can have a variety of geometries, as appreciated by one skilled in the art.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

What is claimed is:

1. A metallic end closure with improved pouring features, comprising:

a peripheral curl which is adapted for interconnection to a neck of a beverage container;

a chuck wall extending downwardly from said peripheral curl;

a countersink interconnected to a lower end of said chuck wall;

an inner panel wall extending upwardly from an interior portion of said countersink;

a central panel having a perimeter and a center point which is located at an intersection of a vertical axis and a horizontal axis, wherein said vertical axis and said horizontal axis form four quadrants, wherein said perimeter of said central panel is interconnected to an upper portion of said inner panel wall;

a score line in said central panel which defines a tear panel, wherein said score line has a first substantially linear portion on a first side of said vertical axis and a second substantially linear portion on a second side of said vertical axis, wherein an upper portion of said tear panel is on a first side of said horizontal axis and a lower portion of said tear panel is on a second side of said horizontal axis, wherein said tear panel comprises a rounded, substantially triangular shape with said upper portion having a width smaller than a width of said lower portion, and wherein said upper portion of said tear panel is substantially the same distance from said perimeter of said central panel as said lower portion of said tear panel from said perimeter of said central panel; and a ring pull tab having a nose end opposite a tail end, wherein a portion of said ring pull tab proximate said nose end is operably interconnected to said tear panel at an interconnection point positioned on said vertical axis between said center point and said perimeter of said central panel, wherein said interconnection point is positioned in only two of said four quadrants and is positioned proximate to said upper portion of said rounded, substantially triangular-shaped tear panel, wherein said ring pull tab is positioned in all four of said four quadrants; and wherein at least a portion of said tail end of said ring pull tab is positioned over an upper surface of said tear panel.

2. The metallic end closure of claim 1, wherein said tear panel is completely detachable from said central panel.

3. The metallic end closure of claim 1, further comprising a first bead positioned proximate to said first substantially linear portion of said score line, said first bead including a substantially linear portion which is aligned substantially parallel to said first substantially linear portion of said score line.

4. The metallic end closure of claim 3, further comprising a second bead raised a height above said central panel and positioned proximate to said second substantially linear portion of said score line, said second bead including a substantially linear portion which is aligned substantially parallel to said second substantially linear portion of said score line, and wherein said central panel has increased rigidity.

5. The metallic end closure of claim 3, wherein said first bead has a length which is longer than a width of said first bead, and wherein said first bead is raised above a substantially horizontal surface of said central panel a height of between about 0.025 inches and 0.035 inches.

6. The metallic end closure of claim 1, wherein said tear panel defines a pour opening of at least about 1.05 square inches.

7. The metallic end closure of claim 1, wherein said tear panel defines a pour opening which comprises at least about 43.3% of a total surface area of the central panel.

8. The metallic end closure of claim 1, wherein said lower portion of said rounded, substantially triangular-shaped tear panel comprises a radius of curvature that is substantially the same as a radius of curvature of said perimeter of said central panel.

9. A metallic end closure with an enlarged detachable tear panel, comprising:

a peripheral curl which is adapted for interconnection to a neck of a beverage container;

a chuck wall extending downwardly from said peripheral curl;

a central panel having a perimeter and a center point which is located at an intersection of a vertical axis and a horizontal axis, wherein said perimeter of said central panel is interconnected to said chuck wall;

a score line in said central panel which defines the enlarged detachable tear panel, said score line having a first linear leg interconnected by a first radius of curvature to a second linear leg which is interconnected to a third leg by a second radius of curvature, said third leg is interconnected to said first linear leg by a third radius of curvature which is substantially the same as the second radius of curvature;

a ring pull tab having a nose end and a tail end, wherein said ring pull tab is operably interconnected to said tear panel at an interconnection point positioned a distance away from said center point on said vertical axis and positioned between said center point and said perimeter of said central panel such that no portion of said interconnection point is on said center point;

a first substantially linear bead raised a first height above said central panel and positioned substantially parallel to said first linear leg of said score line; and a second substantially linear bead raised a second height above said central panel and positioned substantially parallel to said second linear leg of said score line, wherein said first bead and said second bead are positioned outside an outer perimeter of said ring pull tab; and wherein a horizontal distance between said first substantially linear bead and said second substantially linear bead as measured at any point on said first and second substantially linear beads is greater than a horizontal width of said ring pull tab at said ring pull tab's widest point.

10. The metallic end closure of claim 9, wherein said tail end of said ring pull tab is positioned over an upper surface of said tear panel.

11. The metallic end closure of claim 9, further comprising a third bead positioned on said vertical axis between said interconnection point and said center point of said central panel, wherein said third bead is raised a height above said central panel, and wherein said third bead has an ovular shape with its longitudinal axis positioned along said vertical axis.

12. The metallic end closure of claim 9, wherein said first bead has a length and a width, wherein said length of said first bead is longer than said width of said first bead, wherein said length of said first bead is less than approximately 0.57 inches.

13. The metallic end closure of claim 9, wherein said tear panel comprises a rounded, triangular shape, wherein said interconnection point is positioned proximate to an upper portion of said rounded, triangular-shaped tear panel, and wherein a lower portion of said rounded, triangular-shaped tear panel comprises a fourth radius of curvature that is substantially the same as a radius of curvature of said perimeter of said central panel.

14. A method of manufacturing a metallic end closure adapted for interconnection to a neck of a container, comprising:

providing a sheet metal material;

cutting a blank from said sheet metal material; and forming said blank into said metallic end closure, wherein said metallic end closure comprises:

a peripheral curl adapted for interconnection to said neck of said container;

a chuck wall extending downwardly from said peripheral curl;

a countersink interconnected to a lower end of said chuck wall;

an inner panel wall extending upwardly from an interior portion of said countersink;

a central panel having a perimeter and a center point which is located at an intersection of a vertical axis and a horizontal axis, wherein said vertical axis and said horizontal axis form four quadrants, wherein said perimeter of said central panel is interconnected to an upper portion of said inner panel wall;

a score line in said central panel which defines a tear panel, wherein said score line has a first substantially linear portion on a first side of said vertical axis and a second substantially linear portion on a second side of said vertical axis, wherein an upper portion of said tear panel is on a first side of said horizontal axis and a lower portion of said tear panel is on a second side of said horizontal axis, wherein said tear panel comprises a rounded, substantially triangular shape with said upper portion having a width smaller than a width of said lower portion, and wherein said upper portion of said tear panel is substantially the same distance from said perimeter of said central panel as said lower portion of said tear panel from said perimeter of said central panel; and a ring pull tab having a nose end opposite a tail end, wherein said ring pull tab is operably interconnected to said tear panel at an interconnection point positioned on said vertical axis between said center point and said perimeter of said central panel, wherein said interconnection point is positioned in only two of said four quadrants and is positioned proximate to said upper portion of said rounded, substantially triangular-shaped tear panel, wherein said ring pull tab is positioned in all four of said four quadrants; and wherein at least a portion of said tail end of said ring pull tab is positioned over an upper surface of said tear panel.

15. The method of manufacturing a metallic end closure of claim 14, wherein said tear panel is completely detachable from said central panel.

16. The method of manufacturing a metallic end closure of claim 14, further comprising:

forming a first bead positioned proximate to said first linear portion of said score line, wherein said first bead includes a linear portion which is substantially parallel to said first linear portion of said score line; and forming a second bead positioned proximate to said second linear portion of said score line, wherein said second bead includes a linear portion which is substantially parallel to said second linear portion of said score line, wherein said first bead and said second bead increase rigidity of said central panel.

17. The method of manufacturing a metallic end closure of claim 16, wherein said first bead has a length and a width, wherein said length of said first bead is longer than said width of said first bead, and wherein said first bead is raised above a substantially horizontal surface of said central panel a height of at least about 0.025 inches and 0.035 inches.

18. The method of manufacturing a metallic end closure of claim 16, further comprising forming a third bead positioned on said vertical axis between said interconnection point and said center point of said central panel.

19. The method of manufacturing a metallic end closure of claim 14, wherein said tear panel defines a pour opening of at least about 1.05 square inches.

20. The metallic end closure of claim 1, further comprising a third bead positioned on said vertical axis between said interconnection point and said center point of said central panel, wherein said third bead is raised a height above said central panel, and wherein said third bead has an ovular shape with its longitudinal axis positioned along said vertical axis.

* * * * *